US011245231B2

(12) United States Patent
Hamner et al.

(10) Patent No.: US 11,245,231 B2
(45) Date of Patent: Feb. 8, 2022

(54) GROUND SPRING FOR CABLE ASSEMBLY

(71) Applicant: TE CONNECTIVITY CORPORATION, Berwyn, PA (US)

(72) Inventors: Richard Elof Hamner, Hummelstown, PA (US); Jeffrey Stewart Simpson, Mechanicsburg, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/867,796

(22) Filed: May 6, 2020

(65) Prior Publication Data

US 2021/0028581 A1 Jan. 28, 2021

Related U.S. Application Data

(60) Provisional application No. 62/878,462, filed on Jul. 25, 2019.

(51) Int. Cl.

| | |
|---|---|
| ***H01R 13/6584*** | (2011.01) |
| ***H01R 13/631*** | (2006.01) |
| ***H01R 13/627*** | (2006.01) |
| ***H01R 13/6596*** | (2011.01) |

(52) U.S. Cl.

CPC ..... *H01R 13/6584* (2013.01); *H01R 13/6277* (2013.01); *H01R 13/631* (2013.01); *H01R 13/6596* (2013.01)

(58) Field of Classification Search

CPC ..... H01R 13/6584; H01R 13/6277; H01R 13/631; H01R 13/6596; H01R 13/6581–6583; H01R 13/658; H01R 13/648; H01R 13/627; H01R 13/6275; H01R 13/6271; H01R 13/629; H01R 13/62; H01R 13/6591

USPC ..... 439/607.01

See application file for complete search history.

(56) References Cited

U.S. PATENT DOCUMENTS

| | | | | |
|---|---|---|---|---|
| 5,538,440 | A * | 7/1996 | Rodrigues | H01R 13/65912 439/404 |
| 6,012,932 | A * | 1/2000 | Vanbesien | H01R 13/648 439/101 |
| 6,296,519 | B1 * | 10/2001 | Hashizawa | H01R 13/6599 439/607.42 |
| 8,152,559 | B1 * | 4/2012 | Montena | H01R 13/5205 439/394 |
| 9,236,683 | B2 * | 1/2016 | Fransen | H01R 13/6658 |
| 9,583,885 | B2 * | 2/2017 | Ruesca Fernandez | H01R 24/64 |

(Continued)

*Primary Examiner* — Harshad C Patel

(57) ABSTRACT

An electrical connector assembly includes a cable assembly having a cable bundle of cables and a conductive cable shield surrounding and providing electrical shielding for the cable bundle. The cable assembly includes an electrical connector a housing holding contacts and a conductive backshell having a cavity that receives the electrical connector to provide electrical shielding for the electrical connector. The backshell has a cable channel at a rear of the backshell that receives the cable. A ground spring is coupled to the cable and positioned between the cable bundle and the cable shield. The ground spring includes spring members engaging the inner surface of the cable shield and biasing the cable shield radially outward. The ground spring is received in the cable channel and forces the outer surface of the cable shield outward against the backshell to electrically connect the cable shield to the backshell.

20 Claims, 13 Drawing Sheets

(56) References Cited

U.S. PATENT DOCUMENTS

| | | | | |
|---|---|---|---|---|
| 9,615,492 | B2 * | 4/2017 | Brodsky | H05K 9/0015 |
| 9,847,607 | B2 * | 12/2017 | Bopp | H01R 4/2429 |
| 10,008,812 | B1 * | 6/2018 | Hamner | H01R 13/6593 |
| 10,193,281 | B1 * | 1/2019 | Rossman | H05K 9/0018 |
| 10,651,608 | B2 * | 5/2020 | White | H01R 13/65917 |
| 2004/0038582 | A1 * | 2/2004 | Clement | H01R 13/5812<br>439/467 |
| 2008/0268719 | A1 * | 10/2008 | Siemon | H01R 13/6463<br>439/719 |
| 2012/0247805 | A1 * | 10/2012 | Montena | H01R 4/646<br>174/78 |
| 2015/0349468 | A1 * | 12/2015 | Singer | H01R 13/17<br>439/607.19 |
| 2016/0049758 | A1 * | 2/2016 | Ohnuki | H01R 13/518<br>439/638 |
| 2016/0285205 | A1 * | 9/2016 | Ruesca Fernandez | H01R 13/6592 |

* cited by examiner

GROUND SPRING FOR CABLE ASSEMBLY

CROSS REFERENCE TO RELATED APPLICATIONS

This application claims benefit to U.S. Provisional Application No. 62/878,462, filed 25 Jul. 2019, titled "GROUND SPRING FOR CABLE ASSEMBLY", the subject matter of which is herein incorporated by reference in its entirety.

BACKGROUND OF THE INVENTION

The subject matter herein relates generally to a ground spring for a cable assembly.

Electrical connectors that terminate electrical cables may include a housing that provides shielding for one or more electrical contacts held by the housing. For example, the housing may include an electrically conductive coating (e.g., plating), an electrically conductive backshell, and/or another electrically conductive structure that extends around the electrical contacts for shielding the electrical contacts. The shield of the electrical connector is terminated to a cable shield (e.g., a cable braid) of the cable that provides shielding for wires of the cable. The shielding provided by the electrical connector and the cable shield reduce electromagnetic interference (EMI) emissions to and from the cable assembly.

The EMI shielding of at least some known cable assemblies may be inadequate because of the increasing signal speeds being transmitted through cable assemblies. For example, the connection between the electrical connector shield and the cable shield may leak EMI above certain signal speeds, such as above approximately 10 gigahertz (GHz). For example, known cable assemblies dress the cable braid over a ferrule of the housing or a support ring used to hold the cable braid for connection to a backshell. However, the flare of the cable braid may be susceptible to EMI leakage. Dressing or flaring the cable braid may damage the cable braid and/or cause the braiding of the cable braid to loosen and become unbraided leading to insufficient shielding.

Accordingly, there is a need for a cable assembly that reduces EMI emissions.

BRIEF DESCRIPTION OF THE INVENTION

In one embodiment, an electrical connector assembly including a cable assembly having a cable bundle of cables and a conductive cable shield extending between a first end and a second end of the cable. The cable shield surrounds the cable bundle and provides electrical shielding for the cable bundle. The cable shield has an inner surface and an outer surface. The cable assembly includes an electrical connector at the first end of the cable. The electrical connector has contacts terminated to the cables of the cable assembly. The electrical connector has a housing to hold the contacts at a mating end of the electrical connector. The cable assembly includes a backshell coupled to the electrical connector. The backshell has a cavity that receives the electrical connector. The backshell is conductive to provide electrical shielding for the electrical connector. The backshell has a cable channel at a rear of the backshell that receives the cable. The cable assembly includes a ground spring coupled to the cable. The ground spring is positioned between the cable bundle and the cable shield. The ground spring includes spring members engaging the inner surface of the cable shield and biasing the cable shield radially outward. The ground spring is received in the cable channel and forces the outer surface of the cable shield outward against the backshell to electrically connect the cable shield to the backshell.

In another embodiment, an electrical connector assembly includes a cable assembly having a cable bundle of cables and a conductive cable shield extending between a first end and a second end of the cable. The cable shield surrounds the cable bundle and provides electrical shielding for the cable bundle. The cable shield has an inner surface and an outer surface. The cable assembly includes an electrical connector at the first end of the cable. The electrical connector has contacts terminated to the cables of the cable assembly. The electrical connector has a housing holding the contacts at a mating end of the electrical connector. The cable assembly includes a ground spring coupled to the cable rearward of the electrical connector. The ground spring is positioned between the cable bundle and the cable shield. The ground spring includes an inner hub having an opening receiving the cable bundle. The ground spring includes deflectable spring members extending from the inner hub. The spring members are compressed inward by the cable shield and engage the inner surface of the cable shield. The spring members bias the cable shield radially outward and force the outer surface of the cable shield outward to electrically connect the cable shield to a conductive element.

In a further embodiment, a ground spring for a cable assembly is provided. The ground spring includes a first ring member having a first inner hub extending between a first end and a second end. The first ring member includes a first connecting element at the first end and a second connecting element at the second end. The first ring member includes first spring members extending from the first inner hub. The first spring members are compressible radially inward toward the first inner hub. The ground spring includes a second ring member coupled to the first ring member. The second ring member has a second inner hub extending between a third end and a fourth end. The second ring member includes a third connecting element at the third end and a fourth connecting element at the fourth end. The second ring member includes second spring members extending from the second inner hub. The second spring members are compressible radially inward toward the second inner hub. The first and third connecting elements are coupled together and the second and fourth connecting elements are coupled together to form the ground spring. The first and second inner hubs define an opening configured to receive a cable bundle. The first and second spring members circumferentially surround the opening and are compressible toward the opening. The first and second spring members are configured to engage a cable shield and deflect the cable shield outward into electrical contact with a conductive element.

DETAILED DESCRIPTION OF THE INVENTION

Figure 1:
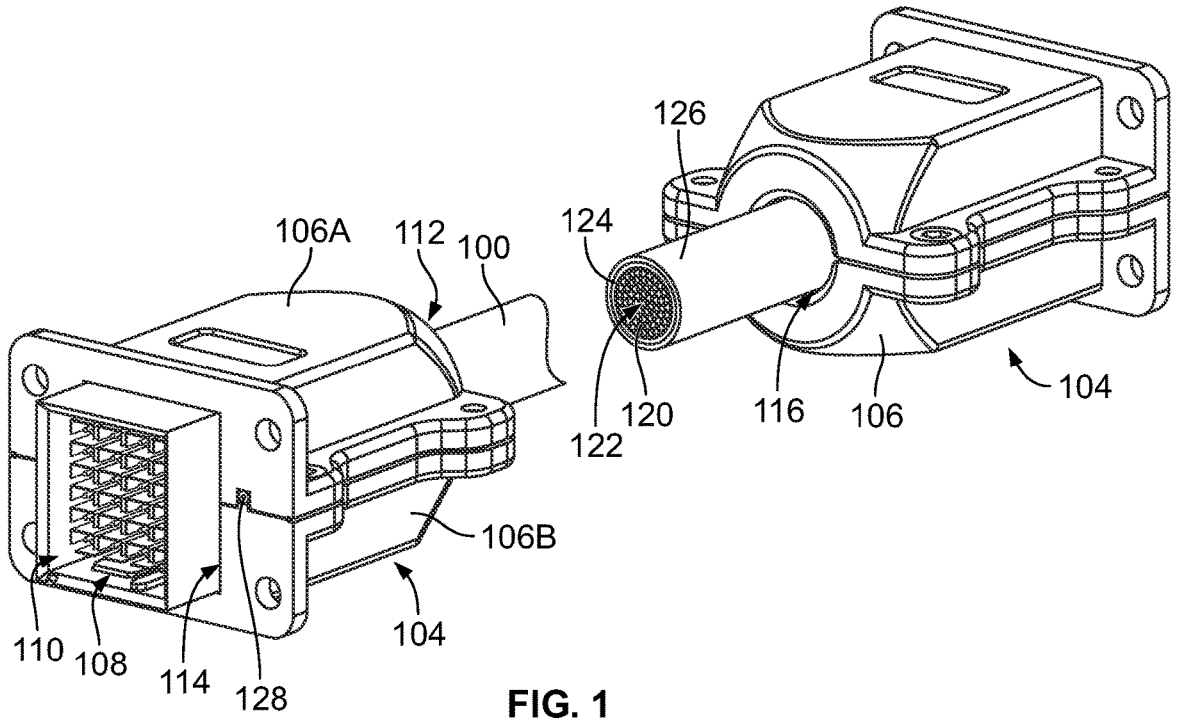
FIG. 1 is a perspective view of a cable assembly in accordance with an exemplary embodiment.

FIG. 1 is a perspective view of a cable assembly 100 in accordance with an exemplary embodiment used in a data communication system. The cable assembly 100 is electrically connected to system components, such as electrical connector assemblies 104 that are disposed on each end of the cable assembly 100 and that terminate to the cable assembly 100. The cable assembly 100 is configured to be electrically connected to one or more conductive elements to electrically ground the cable assembly 100. For example, a cable shield of the cable assembly 100 is configured to be electrically connected to conductive elements of the electrical connector assemblies 104, such as backshells 106 of the electrical connector assemblies 104. However, in alternative embodiments, the cable assembly 100 may additionally or alternatively be electrically connected to a panel or chassis (for example, FIG. 15) of the data communication system.

In the illustrated embodiment, the electrical connector assemblies 104 are high speed, differential pair connectors, however, the electrical connector assemblies 104 may be any other type of connector assembly, such as radio frequency (RF) connectors, or the like. In one or more embodiments, one or more of the electrical connector assemblies 104 may be configured to transmit high-speed data signals, such as, but not limited to, data signals greater than approximately 5 gigabits per second (Gb/s), data signals greater than approximately 10 Gb/s, data signals greater than approximately 15 Gb/S, data signals greater than approximately 20 Gb/S, or the like.

The cable assembly 100 may be used for any application and may be optionally adapted for use in military applications, aerospace applications, automotive applications, industrial applications, commercial applications, communication equipment (e.g., computer servers, internet routers, and/or the like), or the like. Non-limiting examples of such applications include host bus adapters (HBAs), redundant arrays of inexpensive disks (RAIDs), workstations, storage racks, high performance computers, or switches. The cable assembly 100 may be configured to be compliant with industry standards, such as, but not limited to, the small-form factor pluggable (SFP) standard, enhanced SFP (SFP+) standard, quad SFP (QSFP) standard, C form-factor pluggable (CFP) standard, 10 Gigabit SFP standard, which is often referred to as the XFP standard, or the like.

Each electrical connector assembly 104 includes a backshell 106 holding an electrical connector 108. The electrical connector 108 is terminated to an end of the cable assembly 100. In an exemplary embodiment, the body of the backshell 106 is fabricated from a conductive material, such as a metal, metallic alloy, or conductive polymer, to provide electrical shielding for the electrical connector 108. The backshell 106 may be diecast, machined, or the like. The backshell 106 is electrically connected to a cable shield of the cable assembly 100. The electrical connector assembly 104 extends between a mating end 110 and a cable end 112. The cable assembly 100 extends from the cable end 112. The electrical connector assembly 104 is configured to mate with a mating connector (not shown) at the mating end 110. The backshell 106 includes a cavity 114 of the backshell 106 that receives the electrical connector 108. The cable assembly 100 extends into the cavity 114 at the cable end 112.

In an exemplary embodiment, the backshell 106 includes discrete sub-shells 106A, 106B that are connected together to define the backshell 106. For example, in the illustrated embodiment, the electrical connector assembly 104 includes two sub-shells 106A, 106B that are held together by one or more fasteners. The sub-shell 106A may be referred to as an upper shell 106A and the sub-shell 106B may be referred to as a lower shell 106B. The upper shell 106A may be inverted and substantially identical and/or hermaphroditic to the lower shell 106B. For example, the discrete sub-shells 106A, 106B may be fabricated using the same mold. Alternatively, the upper shell 106A or the lower shell 106B may have a unique shape. In one or more embodiments, the electrical connector assembly 104 may include any number of sub-shells 106 that connect together to define the backshell 106. Alternatively, the backshell 106 may be defined by a single shell, such as, but not limited to, a single rigid shell, a single shell having two or more integrally-formed sub-shells that are connected together at a hinge, or the like.

The backshell 106 includes a cable channel 116 at the cable end 112 that extends through the backshell 106. For example, the cable channel 116 may be a passage that extends between the cable end 112 and the cavity 114 when the upper and lower shells 106A, 106B are connected. The cable channel 116 is configured to hold the cable assembly 100 therein such that the sub-shells 106A, 106B support the end of the cable assembly 100. In an exemplary embodiment, the end of the cable assembly 100 is electrically connected to the backshell 106 within the cable channel 116 using a ground spring 200 (shown in FIGS. 2 and 3) that biases the cable shield of the cable assembly 100 into electrical contact with the backshell 106. The backshell 106 provides EMI shielding through the cable channel 116.

The cable assembly 100 includes cables 120 in a cable bundle 122. The cables 120 may be arranged in pairs in the cable bundle as differential pair cables. Each cable 120 has at least one conductor, at least one insulator, a shield (for example, a foil wrap), a jacket, and may include other layers. In various embodiments, the cables 120 may be differential pair cables having a pair of conductors having either a single insulator or a pair of insulators that are surrounded by a shield and a jacket.

In an exemplary embodiment, the cable assembly 100 includes a conductive cable shield 124. In various embodiments, the cable shield 124 may be a cable braid having woven, braided strands. In other various embodiments, the cable shield 124 may be a a conductive fabric, a conductive foil, a conductive tape, and the like, which may be wrapped around the cable bundle 122. The cable shield 124 provides electrical shielding for the cable bundle 122. The cable shield 124 is configured to be electrically connected to the backshell 106 using the ground spring 200.

In an exemplary embodiment, the cable assembly 100 includes an outer sleeve 126 surrounding the cable shield 124. The outer sleeve 126 protects the cable shield 124 of the cable assembly 100. The outer sleeve 126 may be a flexible sleeve, such as a woven or braided sleeve. The outer sleeve 126 may be a molded jacket.

The cable shield 124 is electrically conductive to provide electrical shielding for the wires 120. The cable shield 124 may define an electrical ground and/or shield pathway through the cable assembly 100. The cable shield 124 provides electrical shielding for the wires 120 from external sources of EMI/RFI interference. Optionally, the cable shield 124 may provide flexibility for the cable assembly 100, allowing the cable assembly 100 to bend and flex while maintain shielding integrity. Other types of cable shields may be provided in alternative embodiments, such as, but not limited to, conductive foils or conductive fabrics wrapped helically around the cable bundle 122. Additionally, the cable shield 124 may provide shielding from other types of interference as well to better control electrical characteristics, such as, impedance, cross-talk, and the like, of the wires 120.

In an exemplary embodiment, the electrical connector assembly 104 includes an electromagnetic interference (EMI) gasket 128. The EMI gasket 128 is provided at the seam between the upper and lower backshells 106A, 106B. The EMI gasket 128 extends to the cable channel 116 and interfaces with the cable shield 124. The EMI gasket 128 provides electrical shielding to the electrical connector assembly 104, which may prevent or reduce electromagnetic interference and/or radio frequency interference (RFI) on signal paths defined through the electrical connector assembly 104. The EMI gasket 128 may be a conductive elastomeric gasket, a metallic braided gasket, and the like. Optionally, the EMI gasket 128 may be held within a gasket channel of the backshell 106. The EMI gasket 128 may have a circular cross-sectional shape sized to substantially fill the gasket channel.

Figure 2:
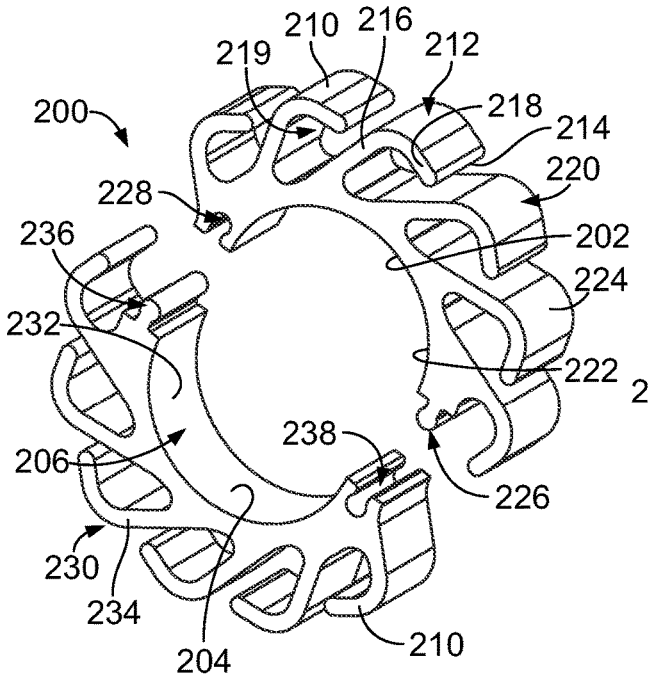
FIG. 2 is an exploded front perspective view of a ground spring of the cable assembly in accordance with an exemplary embodiment.
Figure 3:
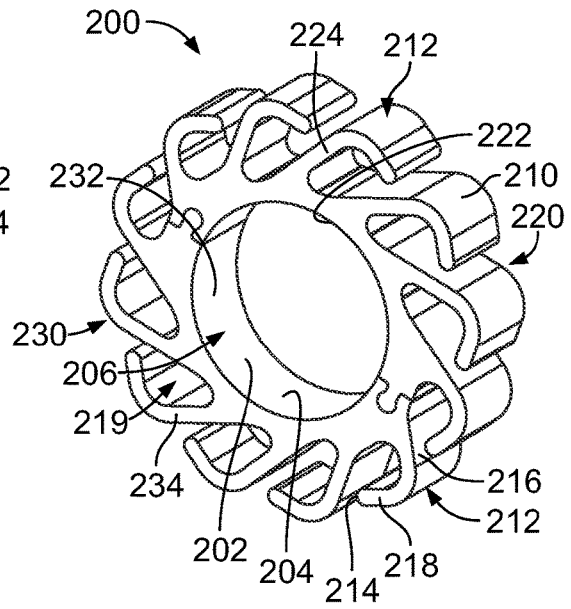
FIG. 3 is an assembled front perspective view of the ground spring shown in FIG. 2 in accordance with an exemplary embodiment.

FIG. 2 is an exploded front perspective view of the ground spring 200 in accordance with an exemplary embodiment. FIG. 3 is an assembled front perspective view of the ground spring 200 in accordance with an exemplary embodiment. The ground spring 200 includes an inner hub 202 having an inner surface 204 facing an opening 206 of the ground spring 200. The opening 206 receives the cable bundle 122 (shown in FIG. 1) of the cable assembly 100 (shown in FIG. 1). In various embodiments, the inner hub 202 protects the cable bundle 122, such as preventing damage or crushing of the cable bundle 122. The ground spring 200 includes spring members 210 extending from the inner hub 202. The spring members 210 include mating interfaces 212 configured to engage and interface with the cable shield 124 (shown in FIG. 1) of the cable assembly 100.

In an exemplary embodiment, the ground spring 200 is a split ring having a first ring member 220 and a second ring member 230. The first ring member 220 is coupled to the second ring member 230 to form the ground spring 200. The first and second ring members 220, 230 may be clipped together. The first and second ring members 220, 230 may be slidably coupled together. The first and second ring members 220, 230 may be hingedly coupled together. Optionally, the first and second ring members 220, 230 may be identical components inverted 180° relative to each other. For example, the first and second ring members 220, 230 may be hermaphroditic.

The first ring member 220 has a first inner hub 222 and first spring members 224 extending from the first inner hub 222. The first ring member 220 extends between opposite ends. The first ring member 220 includes a first connecting element 226 at a first end and a second connecting element 228 at a second end. In the illustrated embodiment, the first connecting element 226 is a tail, such as a dovetail extending from the first end. In the illustrated embodiment, the second connecting element 228 is a channel configured to receive a corresponding tail of the second ring member 230.

The second ring member 230 has a second inner hub 232 and second spring members 234 extending from the second inner hub 232. The second ring member 230 extends between opposite ends. The second ring member 230 includes a first connecting element 236 at a first end and a second connecting element 238 at a second end. In the illustrated embodiment, the first connecting element 236 is a tail, such as a dovetail extending from the first end configured to be received in the second connecting element 228 of the first ring member 220. In the illustrated embodiment, the second connecting element 238 is a channel configured to receive the first connecting element 226 of the first ring member 220.

When assembled, the first and second inner hubs 222, 232 are aligned to form a continuous ring or hub forming the inner hub 202 of the ground spring 200. The first and second inner hubs 222, 232 cooperate to form the opening 206. The spring members 210 are provided circumferentially around the entire outer perimeter of the ground spring 200. In the illustrated embodiment, the spring members 210 extend from the inner hub 202 at angles such that the spring members 210 are overlapping each other. For example, the spring members 210 extend to distal ends 214 with the distal ends 214 overlapping the adjacent spring members 210.

In an exemplary embodiment, the spring members 210 are curved between the inner hub 202 and the distal ends 214, such as at the mating interfaces 212. The mating interfaces 212 may be located remote from the distal ends 214. For example, the spring members 210 may include hub arms 216 extending between the inner hub 202 and the mating interface 212 and distal arms 218 extending between the mating interface 212 and the distal ends 214. The spring members 210 may be curved between the hub arms 216 and the distal arms 218 at the mating interfaces 212. Optionally, the hub arms 216 may be generally flat or on curved and/or the distal arms 218 may be generally flat or on curved with the curved transition between the hub arms 216 and the distal arms 218. The spring members 210 may have other shapes in alternative embodiments.

In the illustrated embodiment, the spring members 210 are cantilevered such that the distal ends 214 are unsupported. However, the distal ends 214 may be supported (for example, engage or bottom out against) by the adjacent spring members 210 or the inner hub 202 in alternative embodiments. The spring members 210 are deflectable, such as when the ground spring 200 is mated to the cable shield 124. For example, gaps 219 may be provided between the spring members 210 and the adjacent spring member 210 and/or the inner hub 202. The spring member 210 is deflectable into the gap 219. For example, the distal ends 214 may be moved toward the adjacent spring member 210 and/or toward the inner hub 202. The diameter of the ground spring 200 is variable by compression and expansion of the spring members 210. For example, the spring members 210 may be squeezed inward during loading of the ground spring 200 into the cable shield 124 and/or into the backshell 106. The spring members 210, when compressed, are configured to press outward against the cable shield 124.

Optionally, in alternative embodiments, the ground spring 200 may include inner spring members (not shown) extending radially inward from the inner hub 202 into the opening 206. The inner spring members are configured to compressed against the cable bundle 122. In such embodiments, the ground spring 200 may additionally include the spring members 210. However, in alternative embodiments, the ground spring 200, with the inner spring members 210, may be devoid of the outer spring members 210. For example, the hub 202 may have a solid or continuous outer surface configured to press against the cable shield 124.

In an exemplary embodiment, the ground spring 200 is manufactured from a plastic material. For example, the ring members 220, 230 may be molded or printed. In other various embodiments, the ground spring 200 may be manufactured from a metal material. For example, the ring members 220, 230 may be stamped, machined, formed by a waterjet, and the like. When manufactured from a metal material or a conductive plastic material, the ground spring 200 may be electrically connected to the cable shield 124.

Figure 4:
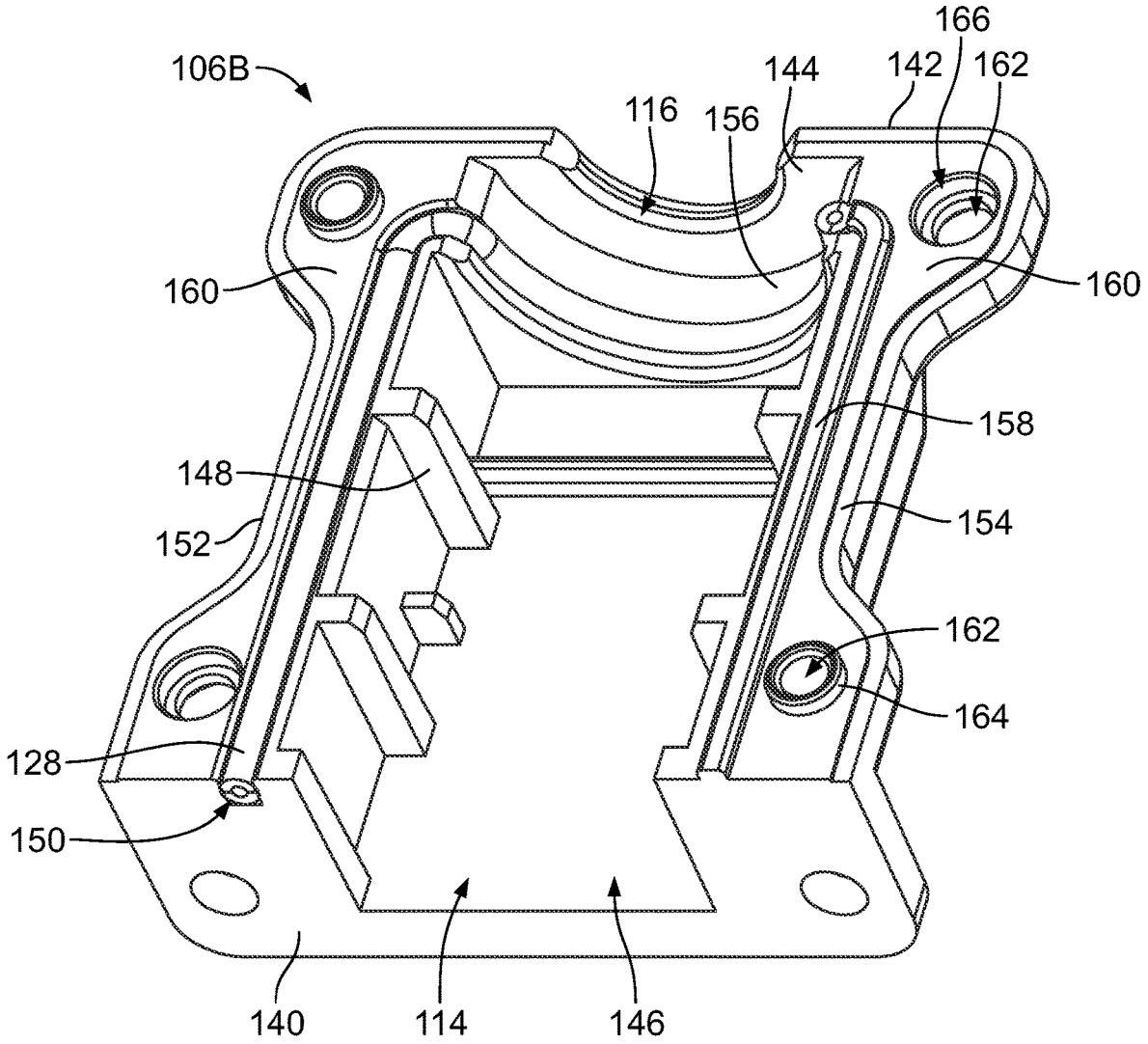
FIG. 4 is a perspective view of a lower backshell of the cable assembly in accordance with an exemplary embodiment.

FIG. 4 is a perspective view of the lower backshell 106B in accordance with an exemplary embodiment. Optionally, the lower backshell 106B may be identical to the upper backshell 106A (shown in FIG. 1). The backshell 106B includes a body defining the cavity 114 and the cable channel 116.

The backshell 106B extends between a front 140 and a rear 142. The cable channel 116 is provided at the rear 142. In an exemplary embodiment, the backshell 106B includes a rear wall 144 at the rear 142. The backshell 106B includes an opening 146 at the front 140. The electrical connector 108 (shown in FIG. 1) is configured to pass through the opening 146 forward of the backshell 106B. The backshell 106B includes locating features 148, such as ribs and/or channels, within the cavity 114 to locate the electrical connector 108 within the cavity 114.

The backshell 106B includes a gasket channel 150 formed in an end wall 160 of the backshell 106B that receives the EMI gasket 128. The gasket channel 150 extends along a first side 152 of the backshell 106B, such as at the end wall 160, to interface with the end wall of the upper backshell 106A. The gasket channel 150 extends from the front 140 to the cable channel 116 at the rear 142. In an exemplary embodiment, the gasket channel 150 extends around the cable channel 116 from the first side 152 to a second side 154. For example, the gasket channel 150 extends along a radial wall 156 of the cable channel 116. The radial wall 156 is used to support and interface with the cable assembly 100 (shown in FIG. 1) when the cable assembly 100 is received in the cable channel 116. The EMI gasket 128 within the gasket channel 150 is configured interface with the cable assembly 100, such as along the radial wall 156.

In an exemplary embodiment, the backshell 106B includes a rib 158 extending along the second side 154 between the front 140 and the rear 142. The rib 158 stands proud of the end wall 160 of the backshell 106B. The rib 158 is complementary to the gasket channel 150 to interface with the EMI gasket 128 received in the upper backshell 106A. The rib 158 is used to press the EMI gasket 128 of the lower backshell 106B into the gasket channel of the upper backshell 106A.

In an exemplary embodiment, the backshell 106*b* includes openings 162 configured to receive fasteners used to secure the lower backshell 106B to the upper backshell 106A. In various embodiments, the backshell 106B may include rims 164 extending from the end wall 160 around one or more of the openings 162. In various embodiments, the backshell 106B may include wells 166 in the end wall 160 around one or more of the openings 162. When the lower backshell 106B is coupled to the upper backshell 106A, the rims 164 are received in corresponding wells of the upper backshell 106A and the wells 166 receive corresponding rims of the upper backshell 106A.

Figure 5:
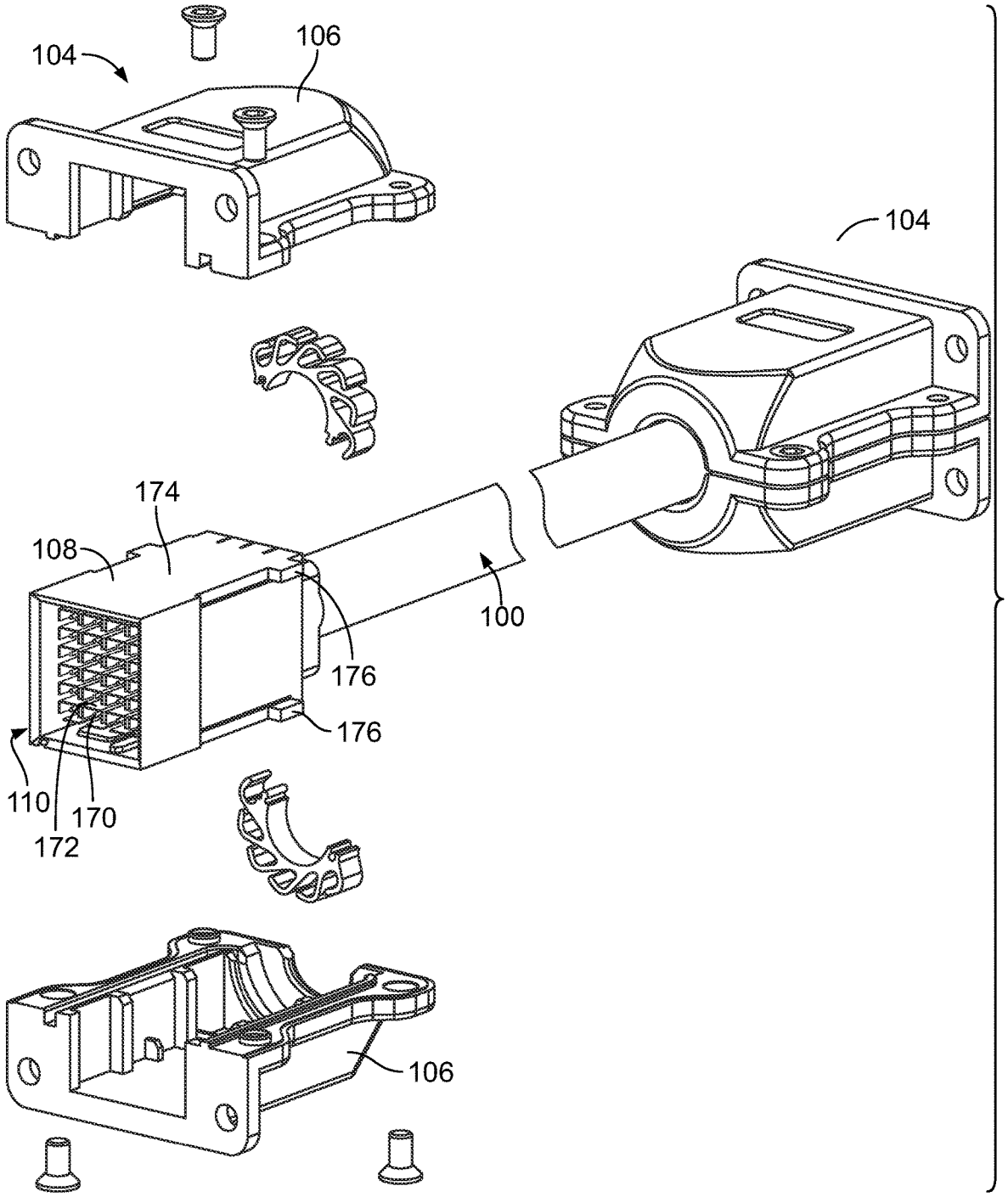
FIG. 5 is an exploded perspective view of the electrical connector assembly configured to be coupled to the cable in accordance with an exemplary embodiment.

FIGS. 5-9 illustrate the cable assembly 100 during various stages of assembly. FIG. 5 is an exploded perspective view of the electrical connector assemblies 104 coupled to the cable assembly 100. FIG. 5 illustrates the electrical connector 108 terminated to the end of the cable assembly 100. For example, the cables 120 of the cable bundle 122 (shown in FIG. 1) are terminated to signal contacts 170 and ground contacts 172 of the electrical connector 108.

The electrical connector 108 includes a housing 174 holding the signal contacts 170 and the ground contacts 172. The signal contacts 170 and the ground contacts 172 are provided at the mating end 110 for mating with a corresponding mating connector (not shown). In various embodiments, the electrical connector 108 may include contact modules (not shown) holding the signal contacts 170 and the ground contacts 172 that are received in the housing 174. The housing 174 includes locating features 176 for locating the housing 174 relative to the backshell 106. In the illustrated embodiment, the locating features 176 are defined by tabs extending from opposite sides of the housing 174, such as proximate to a rear of the housing 174. Other types of locating features may be used in alternative embodiments.

Figure 6:
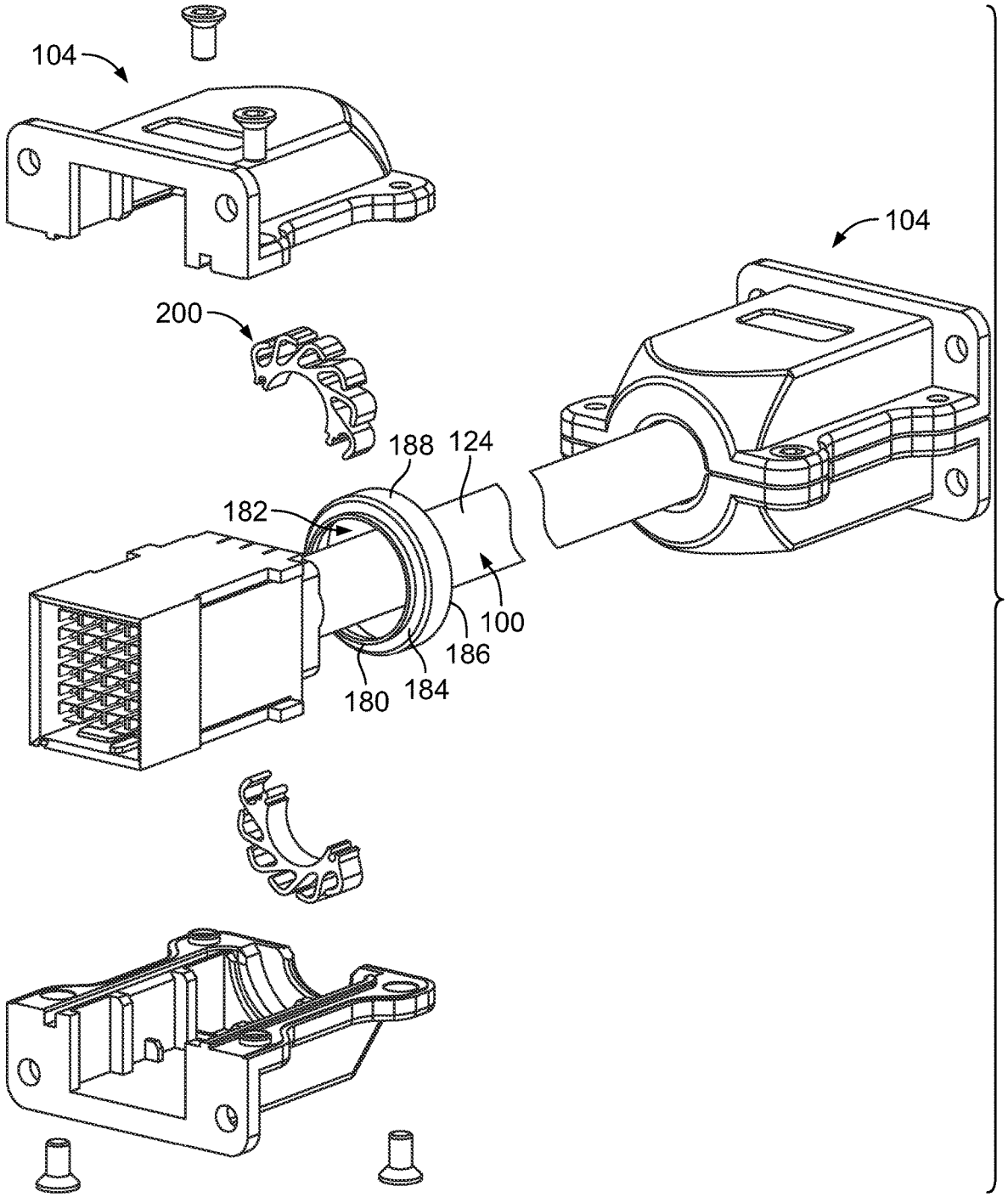
FIG. 6 is an exploded perspective view of the electrical connector assembly configured to be coupled to the cable in accordance with an exemplary embodiment.

FIG. 6 is an exploded perspective view of the electrical connector assembly 104 coupled to the cable assembly 100. During assembly, the cable assembly 100 is prepared to receive the ground spring 200. For example, an end 180 of the cable shield 124 is enlarged to form a pocket 182. The pocket 182 has an enlarged diameter sufficient to receive the ground spring 200 therein. The pocket 182 may be formed by flexing the cable shield 124 outward, such as by compressing the end 180 rearward to bulge the cable shield 124 outward and form the pocket 182. The braids of the cable shield 124 are spread apart to form the pocket 182. In an exemplary embodiment, the braiding of the cable shield 124 is maintained when the pocket 182 is formed. The pocket 182 is defined by a front pocket wall 184, a rear pocket wall 186, and an end pocket wall 188. The end pocket wall 188 defines the diameter of the pocket 182. The end pocket wall 188 has a larger diameter than other portions of the cable bundle 122.

Figure 7:
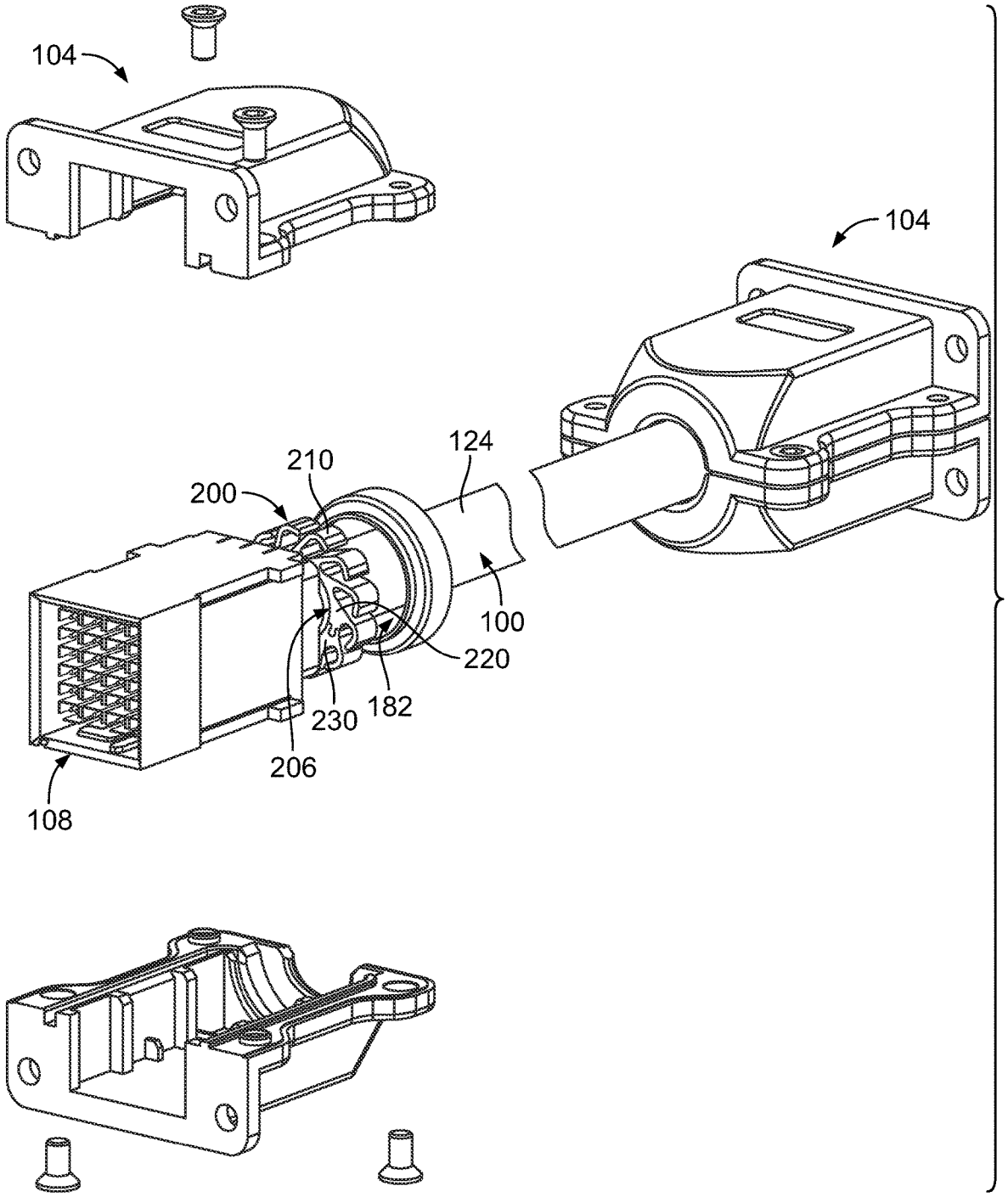
FIG. 7 is an exploded perspective view of the electrical connector assembly configured to be coupled to the cable in accordance with an exemplary embodiment.

FIG. 7 is an exploded perspective view of the electrical connector assembly 104 coupled to the cable assembly 100. FIG. 7 illustrates the ground spring 200 coupled to the cable assembly 100. During assembly, the first ring member 220 and the second ring member 230 are coupled together around the cable bundle 122. For example, the connecting elements 226, 228, 236, 238 (shown in FIG. 2) are coupled together to secure the first ring member 220 and the second ring member 230 around the cable bundle 122. The cable bundle 122 is received in the opening 206 of the ground spring 200. The ground spring 200 is coupled to the cable bundle 122 rearward of the electrical connector 108. In an exemplary embodiment, the ground spring 200 is initially coupled to the cable bundle 122 forward of the pocket 182 of the cable shield 124.

Figure 8:
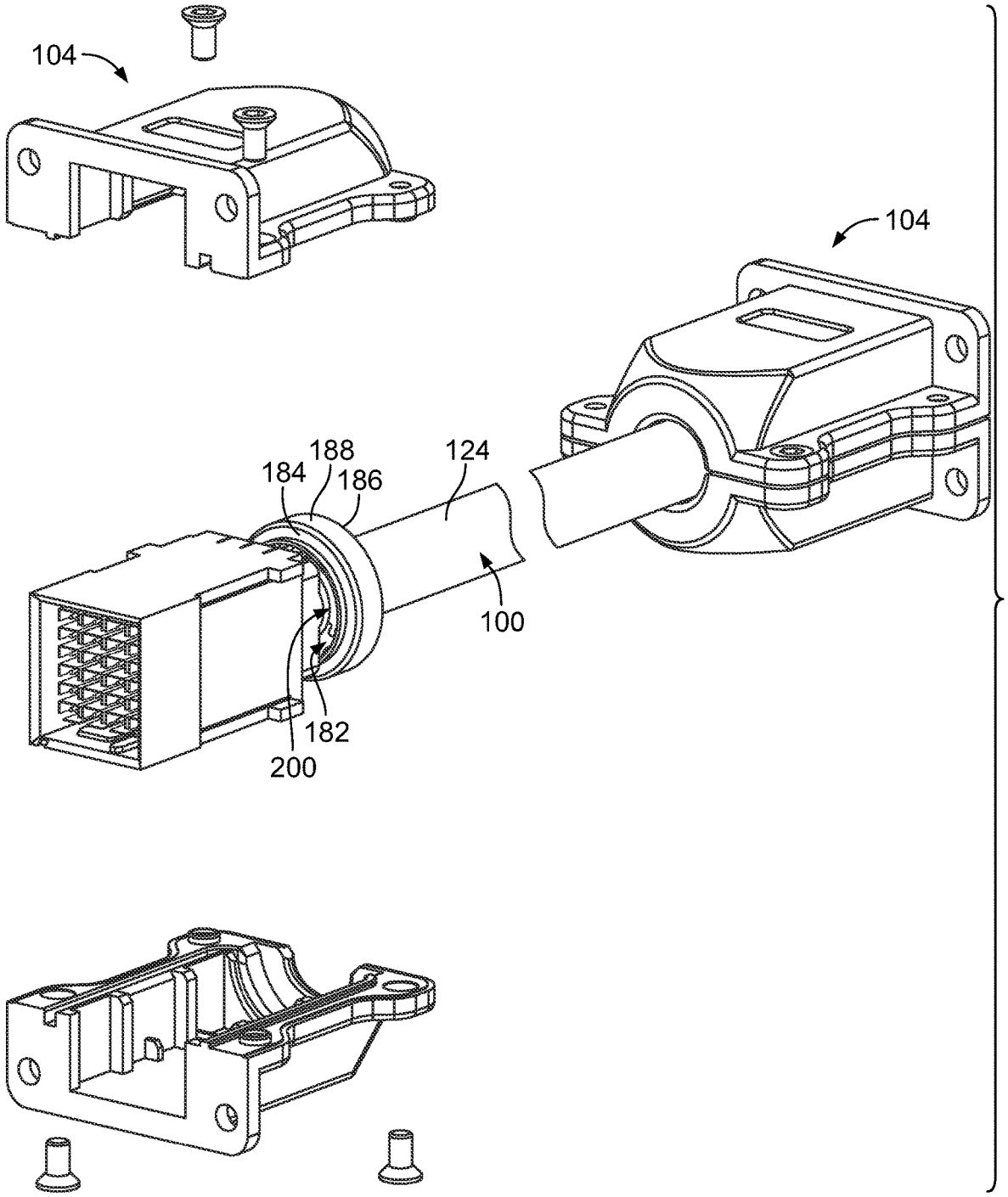
FIG. 8 is an exploded perspective view of the electrical connector assembly configured to be coupled to the cable in accordance with an exemplary embodiment.

FIG. 8 is an exploded perspective view of the electrical connector assembly 104 coupled to the cable assembly 100. FIG. 8 illustrates the ground spring 200 received in the pocket 182. The cable shield 124 surrounds the ground spring 200. During assembly, the ground spring 200 may be slid rearward on the cable bundle 122 into the pocket 182. In other various embodiments, the cable shield 124 and/or the pocket 182 may be slid forward around the ground spring 200 to position the cable shield 124 around the ground spring 200. When assembled, the front pocket wall 184 is located forward of the ground spring 200, the rear pocket wall 186 is located rearward of the ground spring 200 and the end pocket wall 188 surrounds the outer perimeter of the ground spring 200. For example, the end pocket wall 188 surrounds the spring members 210 (FIG. 7). Optionally, the cable shield 124 may compress the spring members 210 to reduce the diameter of the ground spring 200. When compressed, the spring members 210 press radially outward against the inner surface of the cable shield 124.

Figure 9:
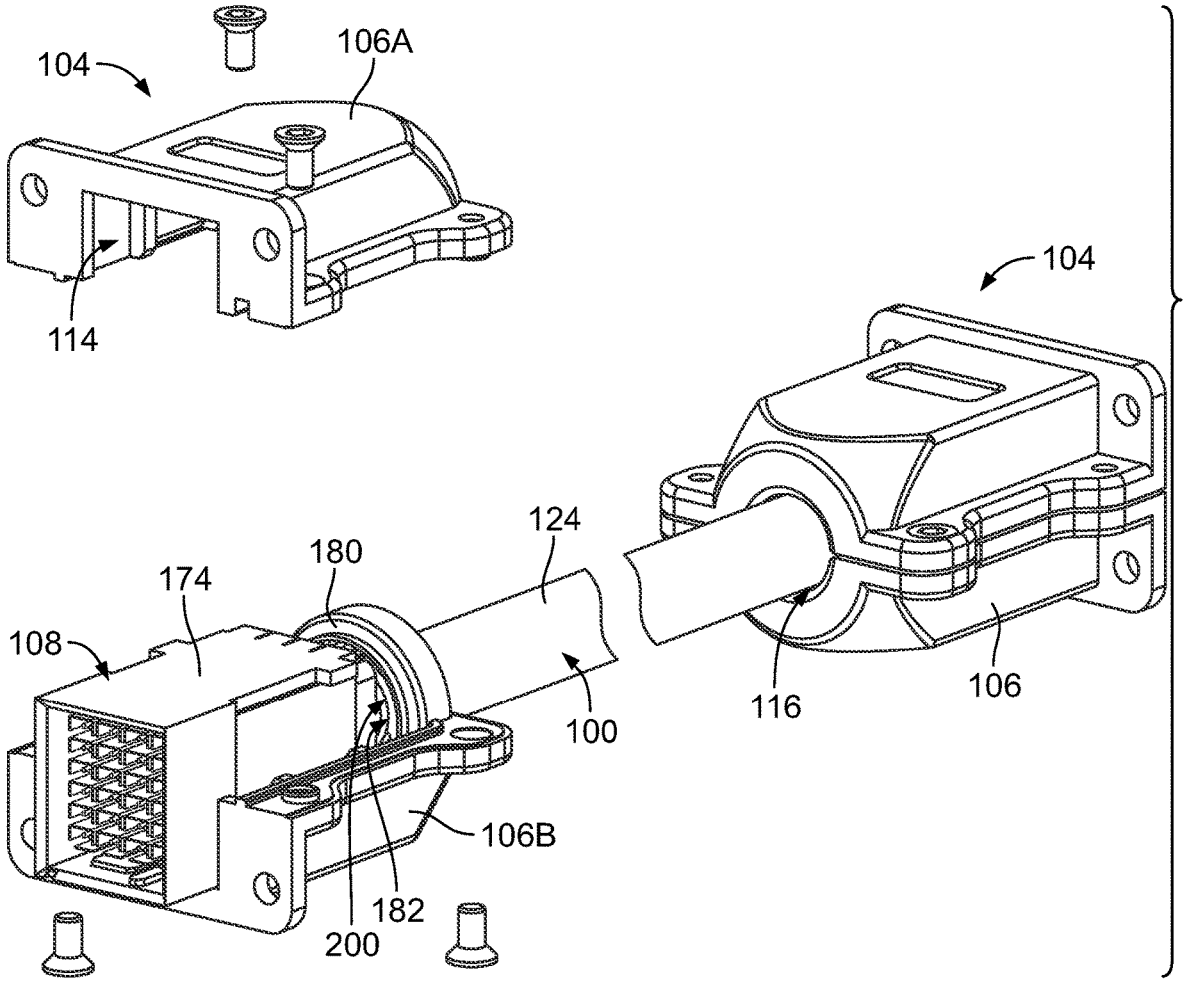
FIG. 9 is an exploded perspective view of the electrical connector assembly configured to be coupled to the cable in accordance with an exemplary embodiment.

FIG. 9 is an exploded perspective view of the electrical connector assembly 104 coupled to the cable assembly 100. During assembly, the backshell 106 is coupled to the electrical connector 108 and the ground spring 200 within the pocket 182 of the cable shield 124. For example, the lower backshell 106B is configured to be coupled to the bottom of the housing 174 and the upper backshell 106A is configured to be coupled to the top of the housing 174. The housing 174 is received in the cavity 114 of the backshell 106.

During assembly, the ground spring 200 and the end 180 of the cable shield 124 are received in the cable channel 116 of the backshell 106. The cable channel 116 is sized and shaped to receive the ground spring 200 and the end 180 of the cable shield 124. The ground spring 200 presses the cable shield 124 outward against the backshell 106 to electrically connect the cable shield 124 to the backshell 106.

Figure 10:
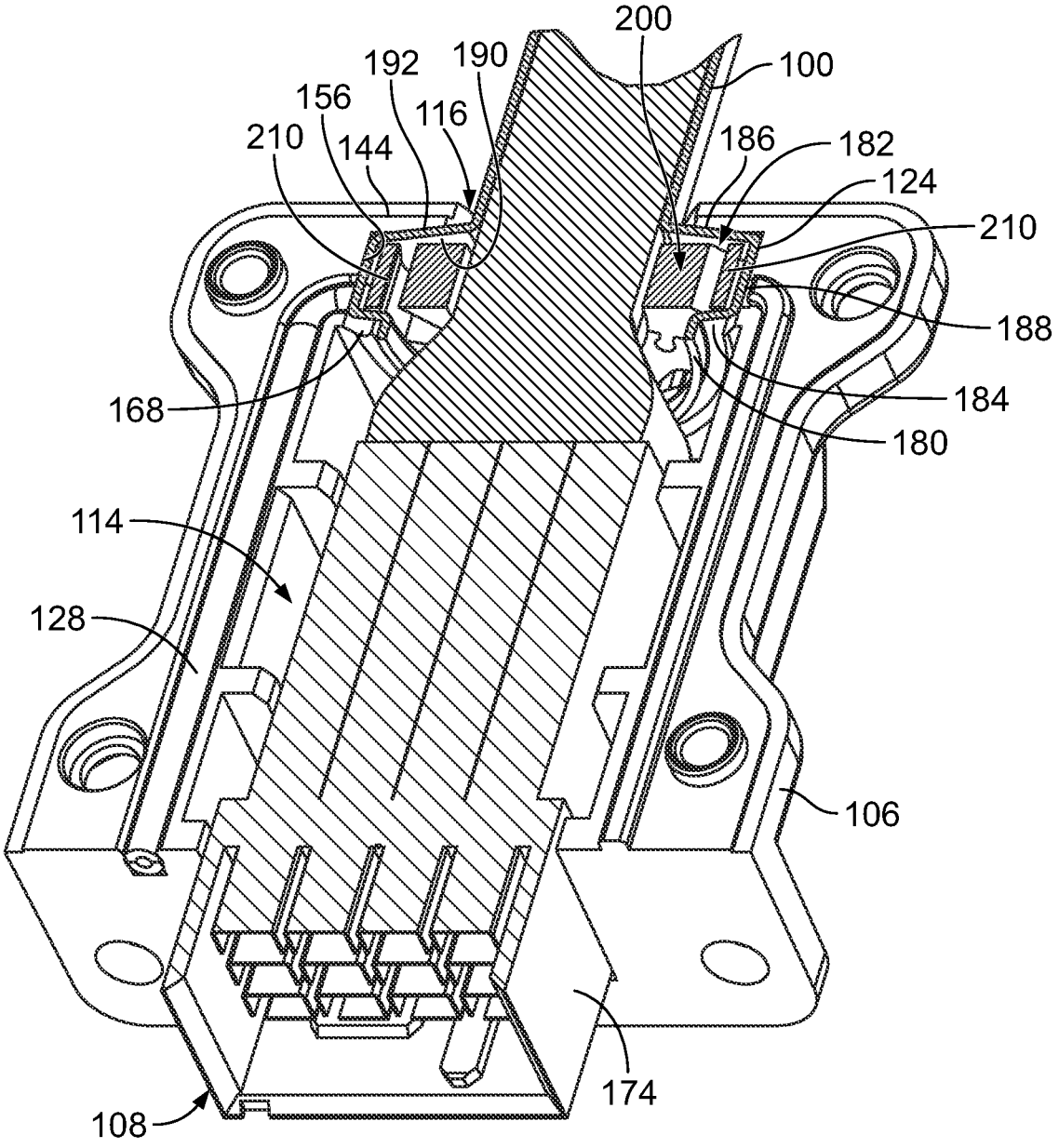
FIG. 10 is a sectional view of a portion of the cable assembly in accordance with an exemplary embodiment.
Figure 11:
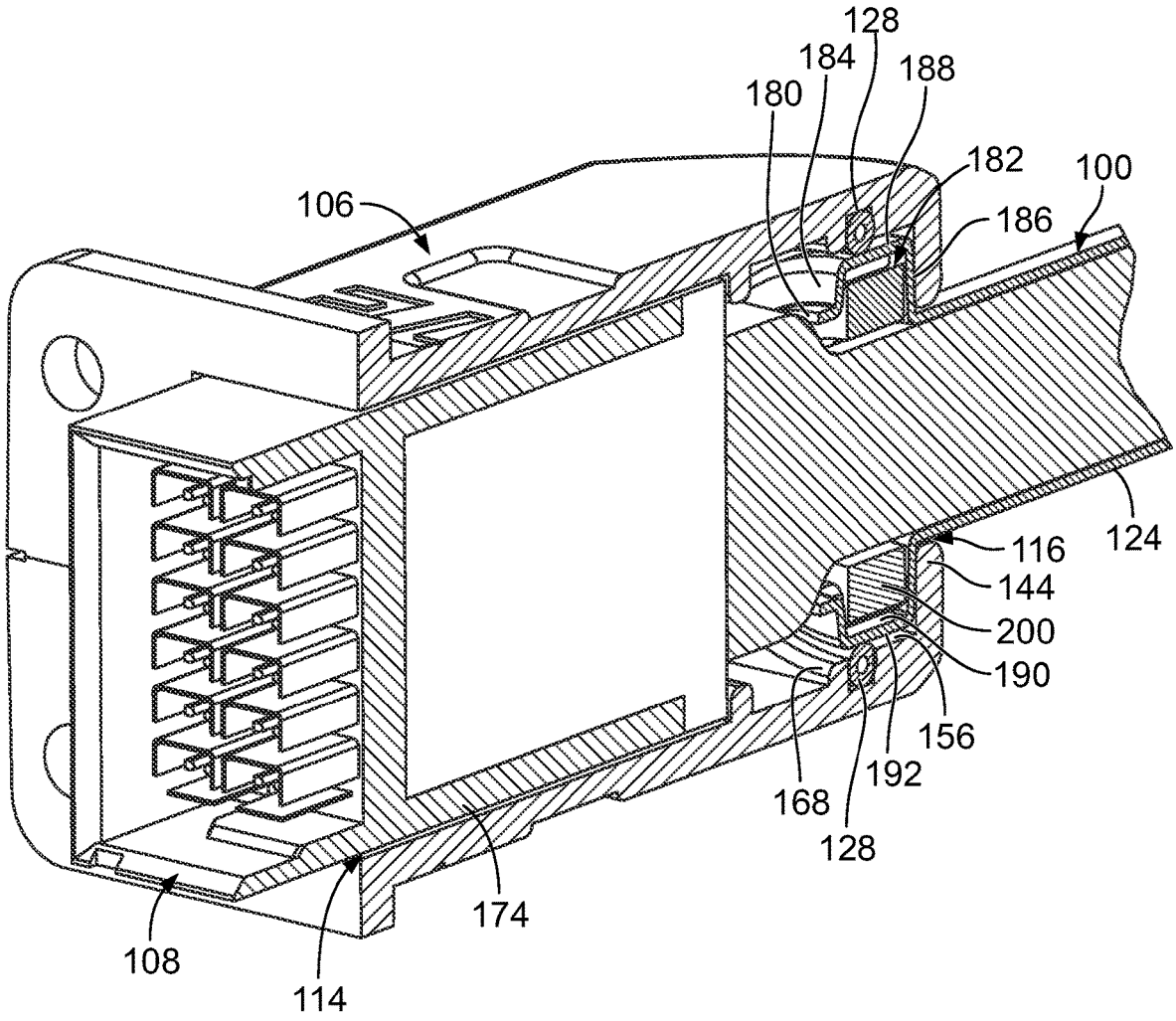
FIG. 11 is a sectional view of a portion of the cable assembly in accordance with an exemplary embodiment.

FIG. 10 is a horizontal sectional view of a portion of the cable assembly 100 illustrating the electrical connector 108, the cable assembly 100, in the ground spring 200 in the backshell 106. FIG. 11 is a vertical sectional view of a portion of the cable assembly 100 illustrating the electrical connector 108, the cable assembly 100, and the ground spring 200 in the backshell 106. The housing 174 is positioned in the cavity 114. The cable assembly 100 passes through the cable channel 116 into the cavity 114.

The ground spring 200 is received in the pocket 182 at the end 180 of the cable shield 124. The ground spring 200 and the end 180 of the cable shield 124 are positioned in the cable channel 116. The ground spring 200 is used to mechanically and electrically connect the cable shield 124 to the backshell 106. The spring members 210 press radially outward against the end pocket wall 188 of the cable shield 124 to press the cable shield 124 into physical contact with the backshell 106 and/or the EMI gasket 128. The spring members 210 engage an inner surface 190 of the cable shield 124 to press an outer surface 192 of the cable shield 124 into direct physical contact with the backshell 106 and/or the EMI gasket 128. In an exemplary embodiment, when the ground spring 200 and the end 180 of the cable shield 124 are received in the cable channel 116, the spring members 210 are compressed and deflected inward by the backshell 106. For example, the radial wall 156 of the backshell 106 may have a diameter that is less than a diameter of the ground spring 200. As such, when the ground spring 200 is received in the cable channel 116, the radial wall 156 compresses the spring members 210 to create an internal spring force or biasing force in each of the spring members 210. The outward spring force or biasing force of the spring members 210 is transferred to the cable shield 124 to maintain the electrical connection between the cable shield 124 and the backshell 106. In an exemplary embodiment, the spring members 210 are located circumferentially around the perimeter of the ground spring 200 to allow 360° electrical connection between the cable shield 124 and the backshell 106 and/or the EMI gasket 128.

In an exemplary embodiment, the cable channel 116 is shaped to retain the ground spring 200 and the end 180 of the cable shield 124 in the cable channel 116. For example, the cable channel 116 may include a front flange 168 used to retain the ground spring 200 and the end 180 of the cable shield 124 in the cable channel 116 between the front flange 168 and the rear wall 144. The front pocket wall 184 may face and/or engage the front flange 168. The rear pocket wall 186 may face and/or engage the rear wall 144. The end pocket wall 188 is pressed outward by the spring members 210 to engage the radial wall 156 and/or the EMI gasket 128.

Figure 12:
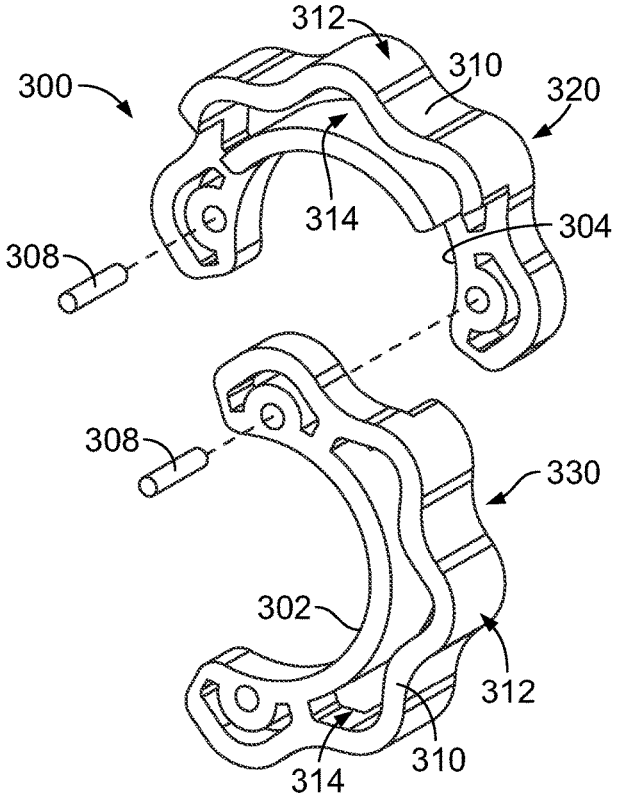
FIG. 12 is an exploded front perspective view of a ground spring in accordance with an exemplary embodiment.
Figure 13:
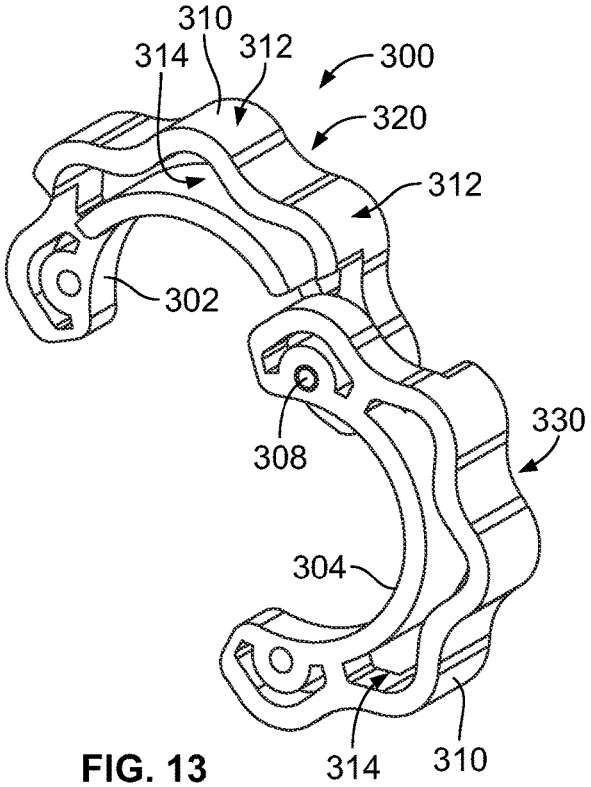
FIG. 13 is a partially assembled front perspective view of the ground spring shown in FIG. 12 in accordance with an exemplary embodiment.
Figure 14:
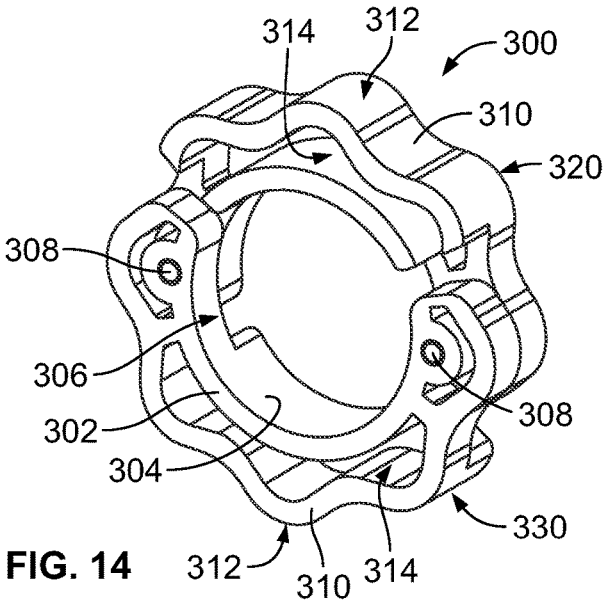
FIG. 14 is a front perspective view of the ground spring shown in FIG. 12 in an assembled state in accordance with an exemplary embodiment.

FIG. 12 is an exploded front perspective view of a ground spring 300 in accordance with an exemplary embodiment. FIG. 13 is a partially assembled front perspective view of the ground spring 300 in accordance with an exemplary embodiment. FIG. 14 is a front perspective view of the ground spring 300 in an assembled state in accordance with an exemplary embodiment. The ground spring 300 is similar to the ground spring 200 (shown in FIGS. 2 and 3) and may be used in place of the ground spring 200 within the cable assembly 100 (shown in FIG. 1). The connecting elements and the spring members of the ground spring 300 are different than the ground spring 200 but the operation and use of the ground spring 300 is the same as the ground spring 200.

The ground spring 300 includes an inner hub 302 having an inner surface 304 facing an opening 306 of the ground spring 300. The opening 306 receives the cable bundle 122 (shown in FIG. 1) of the cable assembly 100 (shown in FIG. 1). The ground spring 300 includes spring members 310 extending from the inner hub 302. The spring members 310 include mating interfaces 312 configured to engage and interface with the cable shield 124 (shown in FIG. 1) of the cable assembly 100.

In an exemplary embodiment, the ground spring 300 is a split ring having a first ring member 320 and a second ring member 330. The first ring member 320 is coupled to the second ring member 330 to form the ground spring 300. In an exemplary embodiment, the first ring member 320 is hingedly or pivotably coupled to the second ring member 330 by a pin 308. Another pin 308 is used to secure the other ends of the ring members 320, 330. Either or both of the pins 308 may be part of the ring member 320 and/or the ring member 330. The first and second ring members 320, 330 may be secured together by other means in alternative embodiments. Optionally, the first and second ring members 320, 330 may be identical components inverted 180° relative to each other. For example, the first and second ring members 320, 330 may be hermaphroditic.

When assembled, the first and second ring members 320, 330 form a continuous ring around the opening 306. The spring members 310 are provided circumferentially around the entire outer perimeter of the ground spring 300. In the illustrated embodiment, both ends of the spring members 310 extend from the inner hub 302 such that both ends of the spring members 310 are supported or fixed relative to the inner hub 302. Gaps 314 are formed between the spring members 310 and the inner hub 302.

In an exemplary embodiment, the spring members 310 are curved forming undulations that define the mating interfaces 312. Optionally, the spring members 310 may have multiple mating interfaces 312 along the spring members 310. The spring members 310 may have other shapes in alternative embodiments.

The spring members 310 are deflectable, such as when the ground spring 300 is mated to the cable shield 124. For example, the spring members 310 may be deflected into the gap 314 toward the inner hub 302. The diameter of the ground spring 300 is variable by compression and expansion of the spring members 310. For example, the spring members 310 may be squeezed inward during loading of the ground spring 300 into the cable shield 124 and/or into the backshell 106 (shown in FIG. 1). The spring members 310, when compressed, are configured to press outward against the cable shield 124.

Figure 15:
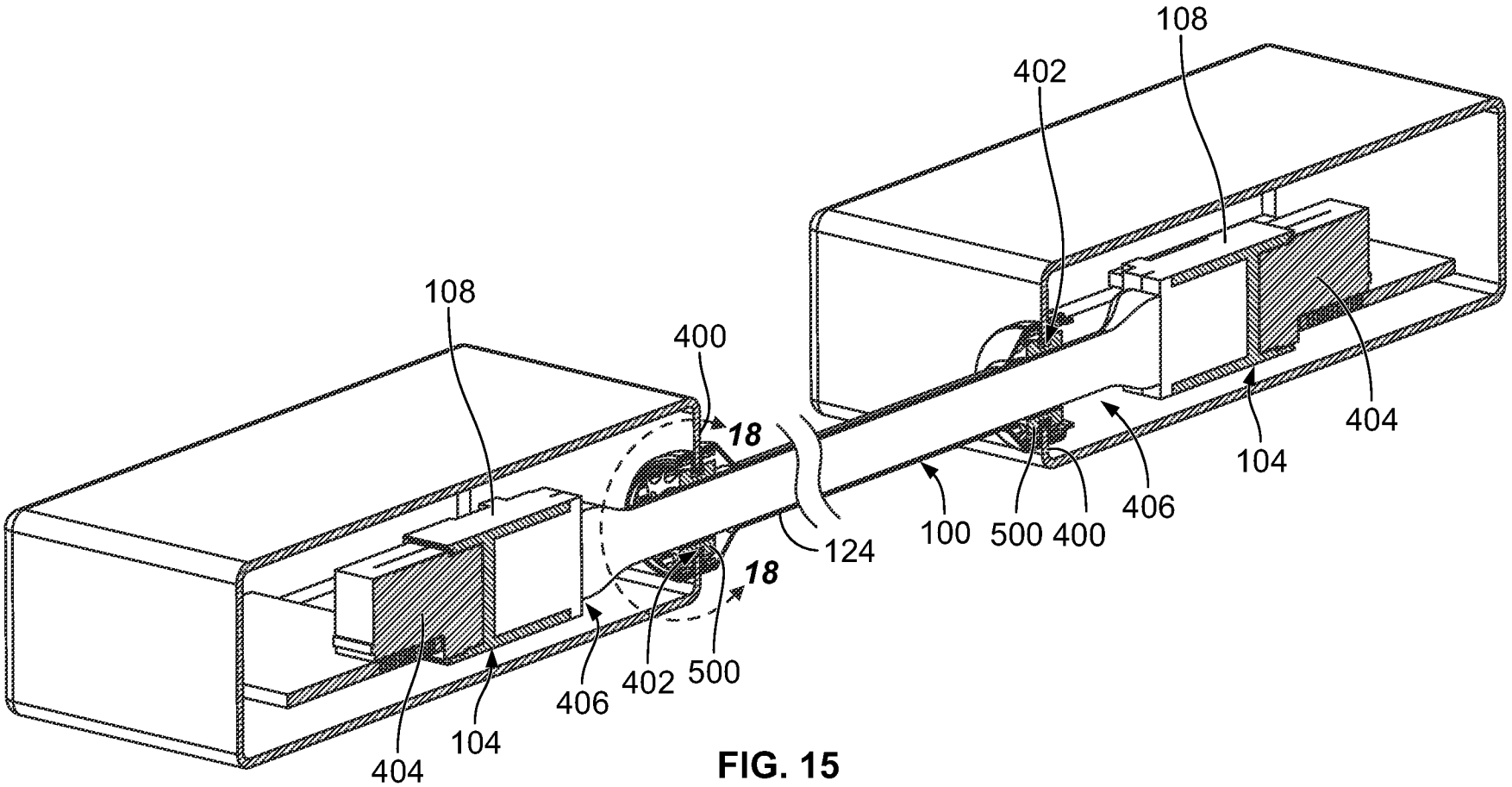
FIG. 15 is a sectional view of the cable assembly in accordance with an exemplary embodiment.

FIG. 15 is a sectional view of the cable assembly 100 in accordance with an exemplary embodiment. The cable assembly 100 of the cable assembly 100 is configured to be electrically connected to a conductive element of the data communication system. For example, in the illustrated embodiment, the cable assembly 100 is electrically connected to panels 400, such as panels of a data communication component. The cable assembly 100 passes through a panel cut out 402 in the panel 400. The cable assembly 100 is electrically connected to the panel 400 at the panel cut out 402. In the illustrated embodiment, the electrical connector assemblies 104 are provided without the back shells 106 (shown in FIG. 1). Rather, the electrical connectors 108 of the electrical connector assemblies 104 are terminated to mating electrical connectors 404 within an enclosure 406 of the data communication component. The panels 400 provide electrical shielding around the enclosure 406 to provide shielding for the electrical connectors 108 and the mating electrical connectors 404.

In an exemplary embodiment, the cable assembly 100 uses ground springs 500 to electrically connect the cable shield 124 of the cable assembly 100 to the panels 400. The ground springs 500 are coupled to ends of the cable shield 124 to electrically connect the cable shield 124 to the panels 400. The ground springs 500 are received in the panel cut outs 402 to mechanically and electrically connect the cable shield 124 to the panels 400.

Figure 16:
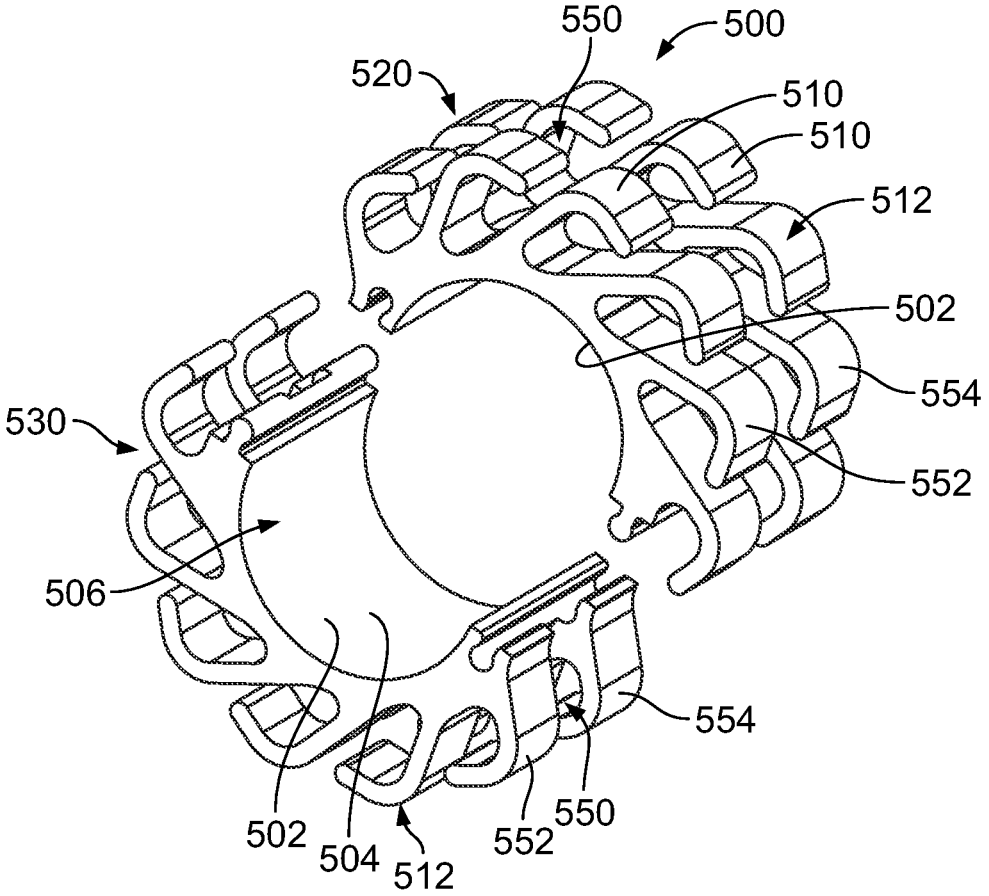
FIG. 16 is an exploded front perspective view of a ground spring in accordance with an exemplary embodiment.
Figure 17:
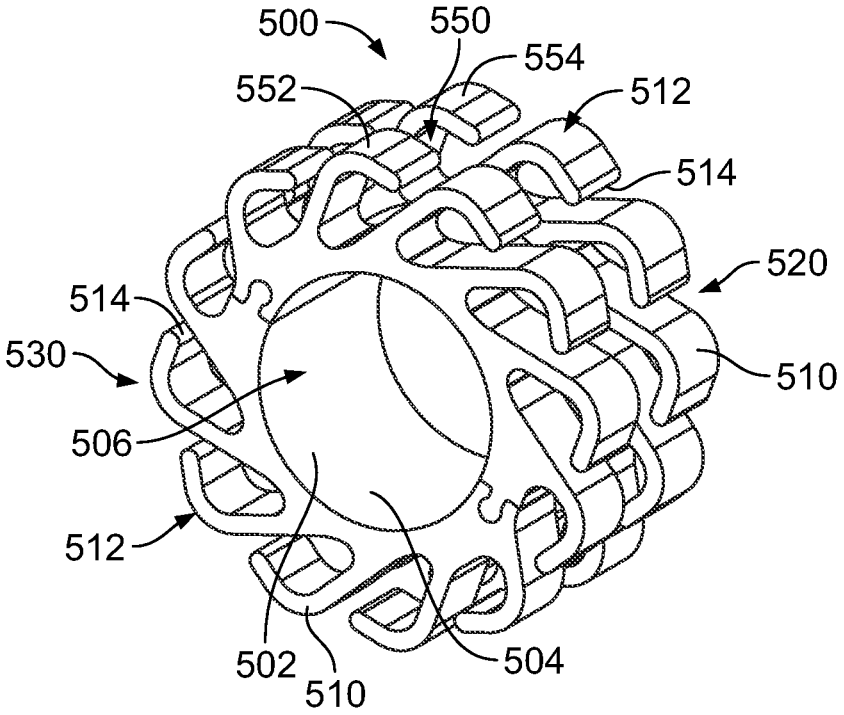
FIG. 17 is an assembled front perspective view of the ground spring shown in FIG. 16 in accordance with an exemplary embodiment.

FIG. 16 is an exploded front perspective view of the ground spring 500 in accordance with an exemplary embodiment. FIG. 17 is an assembled front perspective view of the ground spring 500 in accordance with an exemplary embodiment. The ground spring 500 includes an inner hub 502 having an inner surface 504 facing an opening 506 of the ground spring 500. The opening 506 receives the cable bundle 122 (shown in FIG. 1) of the cable assembly 100 (shown in FIG. 1). The ground spring 500 includes spring members 510 extending from the inner hub 502. The spring members 510 include mating interfaces 512 configured to engage and interface with the cable shield 124 (shown in FIG. 1) of the cable assembly 100.

In an exemplary embodiment, the ground spring 500 is a split ring having a first ring member 520 and a second ring member 530. The first ring member 520 is coupled to the second ring member 530 to form the ground spring 500. The first and second ring members 520, 530 may be clipped together. The first and second ring members 520, 530 may be slidably coupled together. The first and second ring members 520, 530 may be hingedly coupled together. Optionally, the first and second ring members 520, 530 may be identical components inverted 180° relative to each other. For example, the first and second ring members 520, 530 may be hermaphroditic.

In an exemplary embodiment, the spring members 510 of the ground spring 500 are arranged in two rings separated by a circumferential channel 550. For example, the spring members 510 include forward spring members 552 and rearward spring members 554 with the circumferential channel 550 between the forward spring members 552 and the rearward spring members 554. The channel 550 is exterior of the inner hub 502. The channel 550 is configured to receive the conductive element, such as the panel 400 (shown in FIG. 15). In an exemplary embodiment, the first ring member 520 includes both forward spring members 552 and rearward spring members 554 and the second ring member 530 includes both forward spring members 552 and rearward spring members 554. The first ring member 520 includes a portion of the circumferential channel 550 and the second ring member 530 includes a portion of the circumferential channel 550. In alternative embodiments, the ground spring 500 may be further split into a forward portion and a rearward portion that are coupled together, such as at the channel 550. For example, the first ring member 520 may include a forward ring member and a rearward ring member that are coupled together, such as at a centerline at the channel 550 and the second ring member 530 may include a forward ring member and a rearward ring member that are coupled together, such as at a centerline at the channel 550. The forward ring members include the forward spring members 552 and the rearward ring members include the rearward spring members 554.

The spring members 510 are provided circumferentially around the entire outer perimeter of the ground spring 500. In the illustrated embodiment, the spring members 510 extend from the inner hub 502 at angles such that the spring members 510 are overlapping each other. For example, the spring members 510 extend to distal ends 514 with the distal ends 514 overlapping the adjacent spring members 510. In an exemplary embodiment, the spring members 510 are curved between the inner hub 502 and the distal ends 514, such as at the mating interfaces 512. The mating interfaces 512 may be located remote from the distal ends 514. In the illustrated embodiment, the spring members 510 are cantilevered such that the distal ends 514 are unsupported. However, the distal ends 514 may be supported (for example, engage or bottom out against) by the adjacent spring members 510 or the inner hub 502 in alternative embodiments. The spring members 510 are deflectable, such as when the ground spring 500 is mated to the cable shield 124. The spring members 510, when compressed, are configured to press outward against the cable shield 124.

Figure 18:
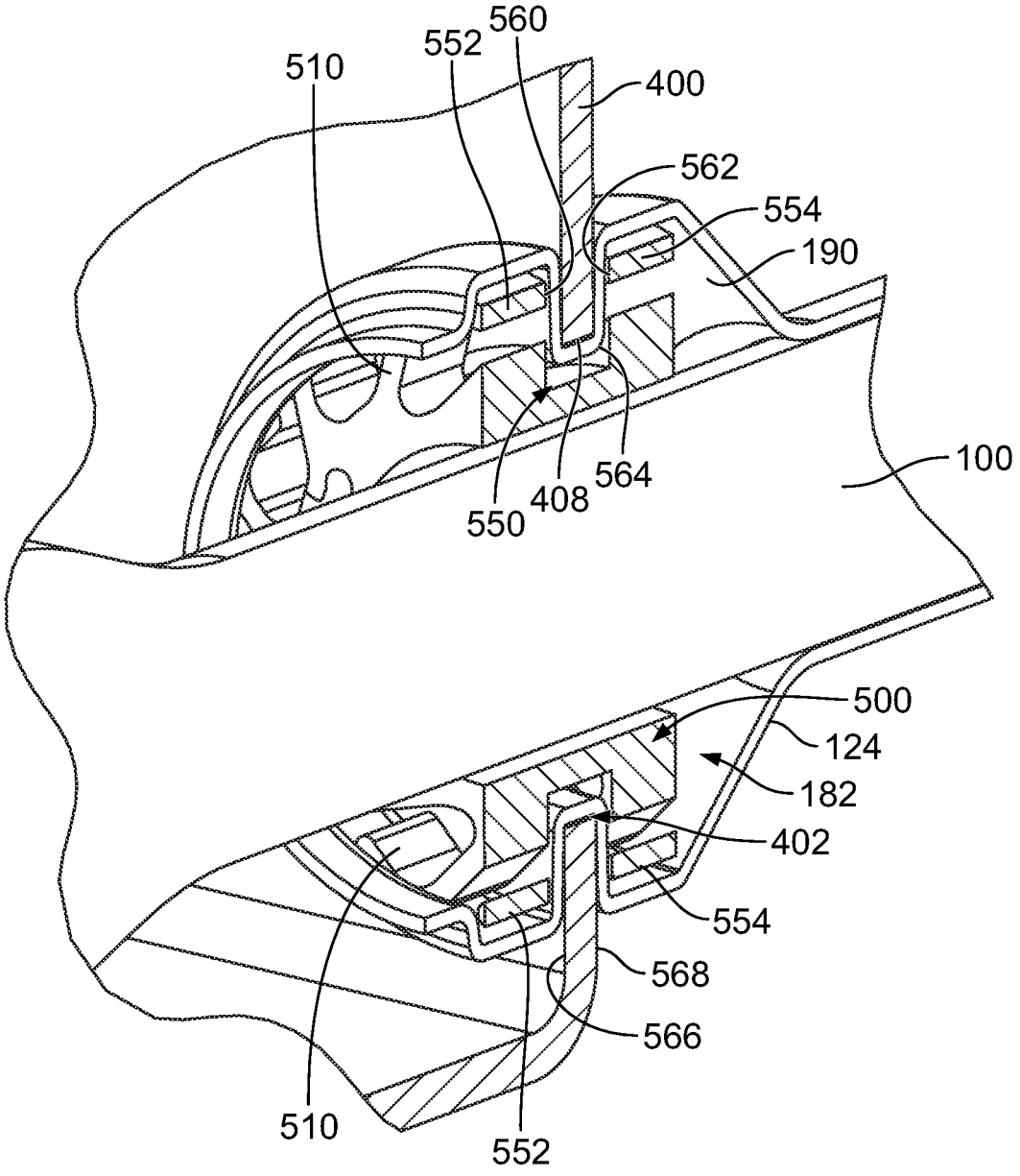
FIG. 18 is a cross-sectional view of a portion of the cable assembly shown in FIG. 15 in accordance with an exemplary embodiment.

FIG. 18 is a cross-sectional view of a portion of the cable assembly 100 in accordance with an exemplary embodiment showing the ground spring 500 and the cable shield 124 coupled to the panel 400. The ground spring 500 is received in the pocket 182 of the cable shield 124. The ground spring 500 and the cable shield 124 are received in the panel cut out 402. The cable assembly 100 passes through the ground spring 500 and the panel cut out 402.

When the ground spring 500 is coupled to the panel 400, the panel 400 and the cable shield 124 are received in the channel 550. The forward spring members 552 are located forward of the panel 400. The rearward spring members 554 are located rearward of the panel 400. The cable shield 124 is positioned between the forward spring members 552 and the panel 400 and the cable shield 124 is positioned between the rearward spring members 554 and the panel 400. The cable shield 124 directly engages the panel 400. For example, the spring members 552, 554 flex the cable shield 124 outward into direct physical contact with an edge 408 of the panel 400 defining the panel cut out 402. In an exemplary embodiment, the cable shield 124 engages the edge 408 entirely circumferentially around (for example, 360° around) the panel cut out 402.

In an exemplary embodiment, the cable shield 124 is sandwiched between the ground spring 500 and the panel 400. For example, the cable shield 124 includes side walls 560, 562 and an end wall 564 that engage the panel 400. The side wall 560 engages a first side 566 of the panel 400 and the side wall 562 engages a second side 568 of the panel 400. The end wall 564 engages the edge 408 of the panel 400. The spring members 510 engage the inner surface 190 of the cable shield 124 and press the cable shield 124 radially outward against the panel 400 to electrically connect the cable shield 124 to the panel 400.

In an alternative embodiment, the ground spring 500 may be coupled to the electrical connector assembly 104 (shown in FIG. 1) having the backshell 106. For example, the rear wall of the backshell 106 may be received in the channel 550 between the forward spring members 552 and the rearward spring members 554.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembly comprising:

a cable assembly having a cable bundle of cables and a conductive cable shield extending between a first end and a second end of the cable, the cable shield surrounding the cable bundle and providing electrical shielding for the cable bundle, the cable shield having an inner surface and an outer surface;

an electrical connector at the first end of the cable, the electrical connector having contacts terminated to the cables of the cable assembly, the electrical connector having a housing holding the contacts at a mating end of the electrical connector;

a backshell coupled to the electrical connector, the backshell having a cavity that receives the electrical connector, the backshell being conductive to provide electrical shielding for the electrical connector, the backshell having a cable channel at a rear of the backshell that receives the cable; and a ground spring coupled to the cable, the ground spring being positioned between the cable bundle and the cable shield, the ground spring including spring members engaging the inner surface of the cable shield and biasing the cable shield radially outward, the ground spring being received in the cable channel and forcing the outer surface of the cable shield outward against the backshell to electrically connect the cable shield to the backshell.

2. The electrical connector assembly of claim 1, wherein the ground spring is a split ring ground spring having a first ring member and a second ring member coupled to the first ring member, the first and second ring members forming and inner hub having an opening receiving the cable bundle.

3. The electrical connector assembly of claim 2, wherein the first ring member is snappily coupled to the second ring member around the cable bundle.

4. The electrical connector assembly of claim 1, wherein the cable shield is spread apart to form a pocket having a larger inner diameter to receive the ground spring therein.

5. The electrical connector assembly of claim 1, wherein the spring members are deflectable and compressible radially inward toward the cable bundle by the cable shield, the spring members being biased outward against the cable shield when compressed.

6. The electrical connector assembly of claim 1, wherein the ground spring includes an inner hub, the spring members extending from the inner hub at angles such that the spring members are overlapping each other.

7. The electrical connector assembly of claim 1, wherein the ground spring includes an inner hub, the spring members extending from the inner hub to distal ends, the distal ends being deflectable toward the inner hub, the spring members having curved mating interfaces between the inner hub and the distal ends.

8. The electrical connector assembly of claim 1, wherein the ground spring includes an inner hub, the spring members extending from the inner hub to press outward against the inner surface of the cable shield, the inner hub being compressed against the cable bundle.

9. The electrical connector assembly of claim 1, wherein an end of the cable shield is located forward of the ground spring between the ground spring and the electrical connector.

10. The electrical connector assembly of claim 1, wherein the cable shield includes a pocket receiving the ground spring, the pocket defined by a front pocket wall, a rear pocket wall, and an end pocket wall between the forward pocket wall and the rear pocket wall, the spring members pressing the end pocket wall outward against a radial wall of the backshell, the rear pocket wall facing and engaging a rear wall of the backshell, the rear pocket wall be located between the spring members and the rear wall of the backshell.

11. The electrical connector assembly of claim 1, wherein the backshell includes a gasket channel receiving an electromagnetic interference (EMI) gasket, wherein the EMI gasket is electrically coupled to the backshell, the EMI gasket extending into the cable channel to interface with the cable shield.

12. An electrical connector assembly comprising:

a cable assembly having a cable bundle of cables and a conductive cable shield extending between a first end and a second end of the cable, the cable shield surrounding the cable bundle and providing electrical shielding for the cable bundle, the cable shield having an inner surface and an outer surface;

an electrical connector at the first end of the cable, the electrical connector having contacts terminated to the cables of the cable assembly, the electrical connector having a housing holding the contacts at a mating end of the electrical connector; and a ground spring coupled to the cable rearward of the electrical connector, the ground spring being positioned between the cable bundle and the cable shield, the ground spring including an inner hub having an opening receiving the cable bundle, the ground spring including deflectable spring members extending from the inner hub, the spring members being compressed inward by the cable shield and engaging the inner surface of the cable shield, the spring members biasing the cable shield radially outward and forcing the outer surface of the cable shield outward to electrically connect the cable shield to a conductive element.

13. The electrical connector assembly of claim 12, wherein the spring members include forward spring members and rearward spring members with a circumferential channel formed between the forward spring members and the rearward spring members exterior of the inner hub, the circumferential channel receiving the conductive element with the forward spring members forward of the conductive element and the rearward spring members rearward of the conductive element, the cable shield positioned between the forward spring members and the conductive element and the cable shield positioned between the rearward spring members and the conductive element.

14. The electrical connector assembly of claim 12, wherein the conductive element is a panel having a panel opening, the ground spring and the cable shield being coupled to the panel within the panel opening.

15. The electrical connector assembly of claim 12, wherein the conductive element is a backshell having a cavity that receives the electrical connector and a cable channel at a rear of the backshell that receives the cable and the ground spring, the backshell being conductive to provide electrical shielding for the electrical connector, the spring members engaging the inner surface of the cable shield and biasing the cable shield radially outward against the backshell to electrically connect the cable shield to the backshell.

16. A ground spring for a cable assembly, the ground spring comprising:

a first ring member having a first inner hub extending between a first end and a second end, the first ring member including a first connecting element at the first end and a second connecting element at the second end, the first ring member including first spring members extending from the first inner hub, the first spring members being compressible radially inward toward the first inner hub; and a second ring member coupled to the first ring member, the second ring member having a second inner hub extending between a third end and a fourth end, the second ring member including a third connecting element at the third end and a fourth connecting element at the fourth end, the second ring member including second spring members extending from the second inner hub, the second spring members being compressible radially inward toward the second inner hub;

the first and third connecting elements being coupled together and the second and fourth connecting elements being coupled together to form the ground spring, the first and second inner hubs defining an opening configured to receive a cable bundle, the first and second spring members circumferentially surrounding the opening and being compressible toward the opening, the first and second spring members are configured to engage a cable shield and deflect the cable shield outward into electrical contact with a conductive element.

17. The ground spring of claim 16, wherein the first ring member is hingedly coupled to the second ring member.

18. The ground spring of claim 16, wherein at least one of the first spring members includes multiple points of contact with the cable shield and wherein at least one of the second spring members includes multiple points of contact with the cable shield.

19. The ground spring of claim 16, wherein the first spring members separated from the first inner hub by a gap and the first spring member is compressible into the gap toward the first inner hub, and wherein the second spring members separated from the second inner hub by a gap and the second spring member is compressible into the gap toward the second inner hub.

20. The ground spring of claim 16, wherein the first spring members extend from the first inner hub to distal ends at angles such that the first spring members are overlapping each other, the distal ends being deflectable toward the adjacent first spring member, the first spring members having curved mating interfaces between the first inner hub and the distal ends thereof, and wherein the second spring members extend from the second inner hub to distal ends at angles such that the second spring members are overlapping each other, the distal ends being deflectable toward the adjacent second spring member, the second spring members having curved mating interfaces between the second inner hub and the distal ends thereof.

* * * * *